United States Patent [19]

Hymes et al.

[11] Patent Number: 5,027,580

[45] Date of Patent: Jul. 2, 1991

[54] CAN SEAMING APPARATUS

[75] Inventors: James E. Hymes, Lakewood; Robert B. Bergan, Golden, both of Colo.

[73] Assignee: Coors Brewing Company, Golden, Colo.

[21] Appl. No.: 561,877

[22] Filed: Aug. 2, 1990

[51] Int. Cl.[5] ..... B21D 37/00; B21D 51/26; B65B 7/28

[52] U.S. Cl. ..... 53/366; 53/393; 413/4; 413/6; 413/27; 413/37

[58] Field of Search ..... 53/366, 367, 371, 393, 53/277, 282, 331.5, 334; 269/55, 289 R; 413/37, 27, 42, 2, 4, 5, 6, 26; 30/400, 401; 81/3.32, 3.39; 279/102

[56] References Cited

U.S. PATENT DOCUMENTS

| | | | |
|---|---|---|---|
| 813,034 | 2/1906 | Beyer | 413/27 |
| 1,373,001 | 3/1921 | Gray | 413/37 |
| 1,433,047 | 10/1922 | Thornburgh | 413/27 |
| 1,646,704 | 10/1927 | Nordquist | 413/27 X |
| 1,929,339 | 10/1933 | Troyer et al. | 413/27 |
| 2,106,739 | 2/1938 | Harrison | 53/366 X |
| 2,323,914 | 7/1943 | Jordan et al. | 413/27 |
| 4,470,738 | 9/1984 | Togo et al. | 413/37 |

*Primary Examiner*—Horace M. Culver
*Attorney, Agent, or Firm*—Klaas & Law

[57] ABSTRACT

A support pad is disclosed for supporting a can body member on a chuck mechanism during a seaming operation. The support pad includes an annular insert made of a ceramic material such as a whisker reinforced alumina material. The annular insert supports the rim of a can body member during the seaming operation. A vent passage is provided extending from a central portion of the upper surface of the support pad to a peripheral side surface for venting the space between the bottom wall of the can member and the base plate.

7 Claims, 5 Drawing Sheets

CAN SEAMING APPARATUS

This invention relates to can seaming apparatus, and more particularly to apparatus for supporting a filled can body member during attachment of a lid member to the filled can body member.

At the present time, beer and soft drink beverages are primarily packaged in two-piece metallic cans made of aluminum or steel material. A two-piece can comprises a body member and a lid member. The body member is made of one piece of metallic material having a cylindrical side wall, a bottom wall and an upper circular opening surrounded by an annular flange portion. The lid member is made of one circular piece of metallic material having an annular flange portion adapted to be sealably connected to the annular flange portion of the body member by "seamer" apparatus. The lid member includes an "opening device" such as a tab to enable access to and removal of the contents of the can.

During packaging of a beer or beverage produce, the can body member is filled with the product by filling apparatus; then the lid member is placed on the can body member over the upper opening; and then the annular flange portion of the lid member and the annular flange portion of the body member are sealably connected by seamer apparatus.

The seamer apparatus comprises a continuously rotatable multiple station (e.g. 8, 10, 12 stations) turret wheel with an upper chuck mechanism for holding and rotating a lid member and a lower chuck mechanism for holding and rotating a can body member relative to seaming tools mounted adjacent thereto. A removable and replaceable support pad means is mounted on the lower chuck mechanism to support the can body member. The can body members are slidably moved onto and off of the support pad means before and after the seaming operation. During the seaming operation, the can body member is lifted into engagement with a lid member held by the upper chuck mechanism and rotated by the lower chuck mechanism under heavy column load. The can body members are subject to some relative rotation between the can body member and the support pad means. As a result, the bottom portions of the can body members are subject to abrasion and the pad means are subject to both abrasion and deposit of aluminum oxide from the can body members. Thus, high friction conditions may develop causing increased wear and resulting in damage to the can body members.

In the past, the bottom portions of the can body members have been coated with a soap or lubricant to reduce wear and tear. However, such coatings increase cost of manufacture and are subject to environmental regulations. In addition, the surfaces of steel pad members have been highly polished and coated. In some instances, the pad members have been made from plastic material such as high density polyethylene. Also, in some instances, the engagement between the can bottom and the pad means may create a pressure lock interfering with smooth-sliding action therebetween. During a seaming operation, the bottom wall portion of can body member is supported on a pad member. One or more seaming tool devices engage the annular flange portion of the lid and forces it and the associated annular flange portion of the can body member into curled overlapping sealed relationship. During the seaming operation, alignment and parallelism of the can members and the tooling is critical to achieving satisfactory, non-leaking sealing engagement between the can body member and the lid member. The seaming apparatus operates at relatively high speeds of 1200 or more cans per minute. The can body member support pad member is subject to a substantial amount of wear and tear caused by forces applied during mounting, filling and removal of the can body member.

The primary object of the present invention is to reduce wear and tear of the can body member and the support pad member, improve durability and life, and reduce seam failure. In general, the invention comprises the use of a support pad having a metallic base portion and a ceramic ring portion which supports the bottom of the can body member during the seaming operation.

BRIEF DESCRIPTION OF DRAWINGS

Illustrative and presently preferred embodiments of the invention are shown in the accompanying drawing in which.

DETAILED DESCRIPTION

Figure 1:
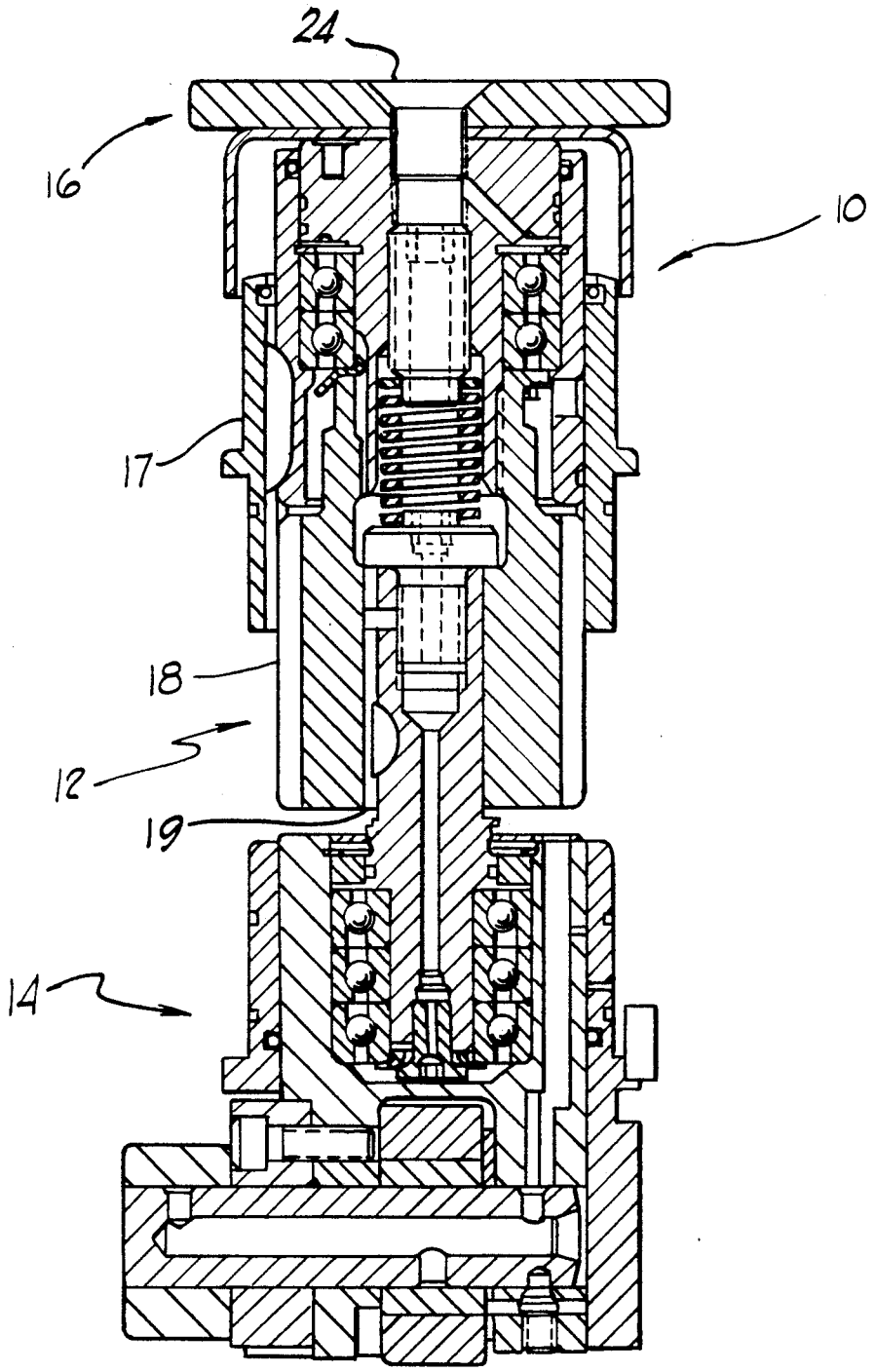
FIG. 1 is a cross-sectional view of a conventional lower chuck apparatus of a conventional seamer machine with one type of conventional support pad member mounted thereon.
Figure 2:
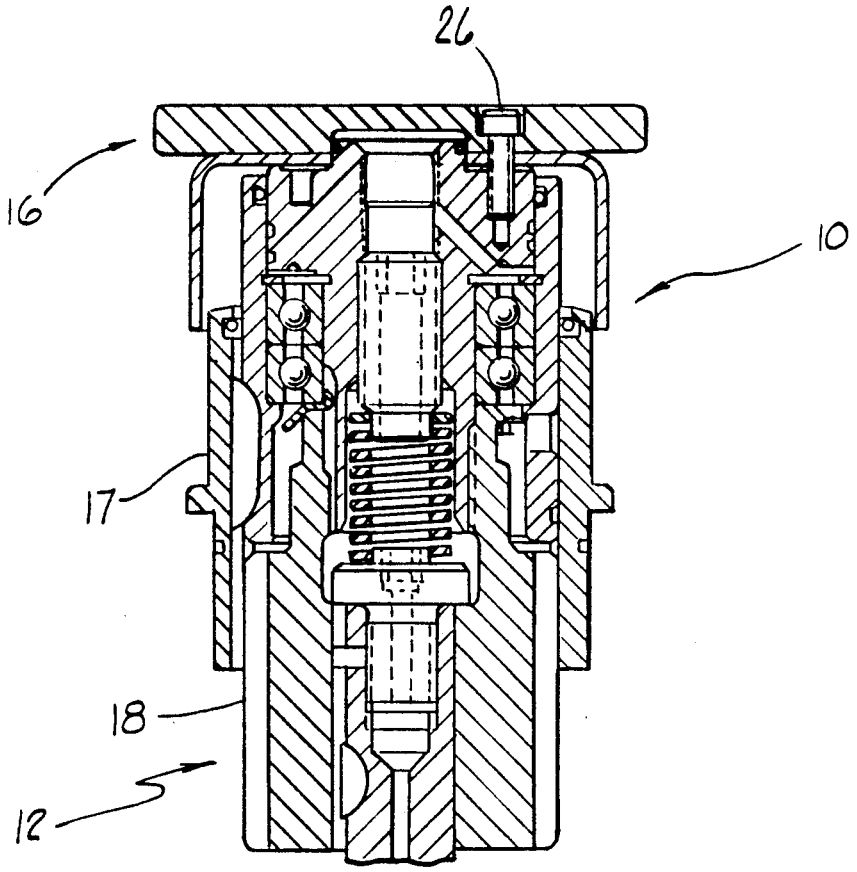
FIG. 2 is a cross-sectional view of a portion of a conventional lower chuck apparatus with another type of support pad member mounted thereon.

As shown in FIGS. 1 & 2, the support pad means of the present invention is adapted for use with a conventional lower chuck assembly 10 of a conventional seaming machine such as manufactured by Angelus Sanitary Can Machine Co. In general, the chuck assembly 10 comprises a rotatable drive means 12 supported by a cam-operated lift mechanism 14. A removable and replaceable support pad means 16 is fixedly mounted on the top of chuck assembly 10. The support pad means 16 is rotatably driven through a gear housing 17 by gear member 18 mounted on shaft member 19. The chuck assembly is axially slidable upwardly and downwardly by a lift mechanism comprising cam follower roller members 20, 21 on a shaft 22, operable by a cam device (not shown), to lift the support pad means 16 between a lowermost position and an uppermost position whereat a can body member is located in engagement with a lid member supported by an upper chuck assembly (not shown). In the embodiment of FIG. 1, the pad means is mounted by a single centrally located screw member 24. In the embodiment of FIG. 2, the pad means is mounted by three circumferentially spaced screw members 26. Details of operation of the chuck apparatus are available by reference to operating manuals published by Angelus Sanitary Can Machine Co.

Figure 3:
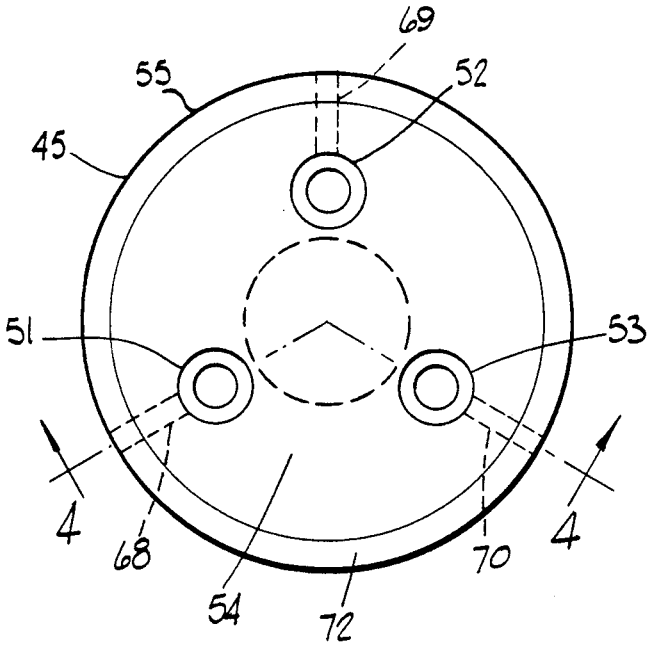
FIG. 3 is a plan view of a support pad member made of metallic material.
Figure 4:
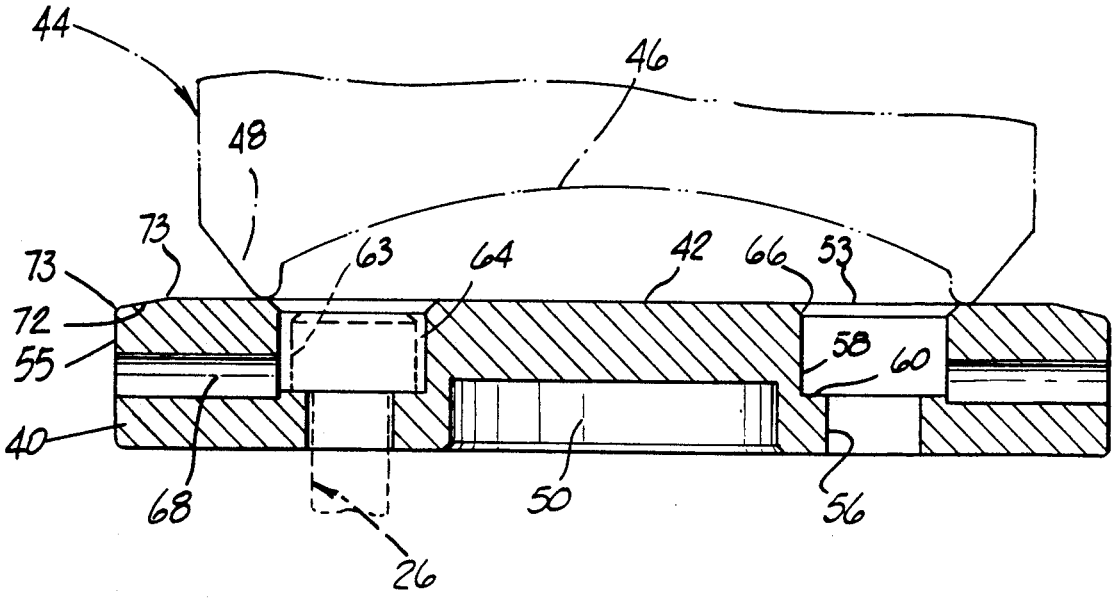
FIG. 4 is a partial cross-sectional view of the support pad member of FIG. 3.

FIGS. 2–3, show a pad means comprising an annular stainless steel plate member 40 having a flat upper surface 42 for supporting a conventional one-piece can body member 44 having a dome-shape bottom wall portion 46 and an annular lowermost support rib portion 48 as shown in phantom in FIG. 4. The plate member is heat treated to RC 55-60, subject to a finish grind and coated with a layer of NEDOX CR+ having a thickness of 0.002 to 0.003 inch. The plate member has a central cavity 50 and a plurality of equally circumferentially spaced bores 51, 52, 53 located along a circle 54 and radially inwardly of the peripheral annular side surface 55. Each bore comprises a relatively small diameter lowermost bore portion 56 and a relatively large diameter uppermost counterbore portion 58 providing an annular abutment shoulder 60. The plate member is fixedly attached to the chuck apparatus by flat-headed attachment screw members 62 mounted in the bores 51, 52, 53 as shown in phantom in FIG. 4. Each screw member has a cylindrical head portion 63 having a diameter substantially less than the diameter of counterbores 58 to provide an annular air passage 64 thereabout and a shank portion 66 having a diameter approximately equal to the diameter of bore portion 58 to provide a minimum clearance fit therebetween. In the assembled position, the head portions are fully tightly seated on shoulder portions 60 which prevents passage of air therebetween. The counter-bores have chamfer surfaces 66 which intersect the upper surface 42 at approximately the contact line between the annular rib portion 48 and the upper surface 42. Each of the counterbores may be connected to a radial extending air passage 68, 69, 70 to provide a means to exhaust high pressure air from the pocket below the dome bottom wall portion and prevent creating of a high pressure air pocket during the seaming operation. An inclined peripheral ramp means is provided by a flat inclined surface 72 (6 degree angle of inclination) and curved surfaces 73, 74 to facilitate sliding movement of can body members across the plate member to and from the central seaming position.

Figure 5:
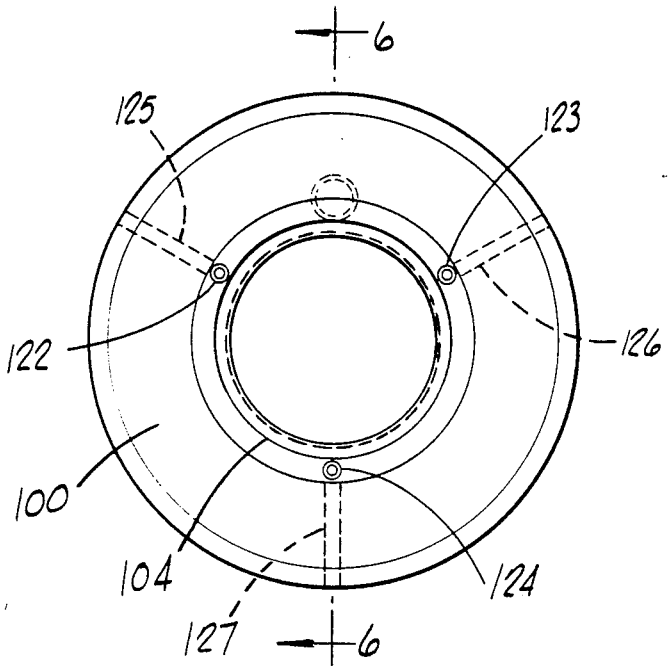
FIG. 5 is a plan view of a support pad member having a ceramic insert.

In one embodiment of the present invention employing a three screw attachment arrangement, as shown in FIGS. 4 & 5, the pad means comprises an annular ring member 100 made of ceramic material fixedly mounted in a peripheral annular recess 102 in a stainless steel plate member 104 having a central bolt hole 105. The recess 102 has a flat radially extending annular bottom surface 105 and an annular inner peripheral side surface 106. The ceramic ring member is preferably made of WRA/10 Whisker Reinforced alumina ceramic material and attached by a suitable bonding material. The ceramic ring member has a flat upper surface 108, an inclined flat edge surface 110 with rounded corner portions 111, 112, annular inner and outer peripheral side surfaces 114, 116, and a flat bottom surface 118. The upper ceramic surface 108 and the upper metallic surface 120 are ground flat and polished to provide a smooth, continuous upper surface. Pressure relief passage means may be provided by circumferentially spaced vertical cores 122, 123, 124 and radially extending bores 125, 126, 127. An alignment pin hole is provided at 128. The inner peripheral side surface 114 of the ceramic member is located closely adjacent the vertical passages and spaced radially outwardly therefrom a distance so that the annular rib portion of the can body member is supported on the ceramic surface in the seaming position.

Figure 6:
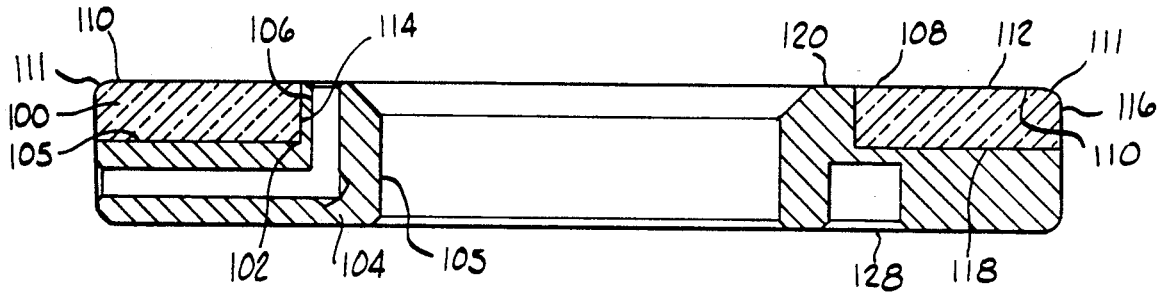
FIG. 6 is an enlarged cross-sectional view of the support pad, member of FIG. 5.
Figure 7:
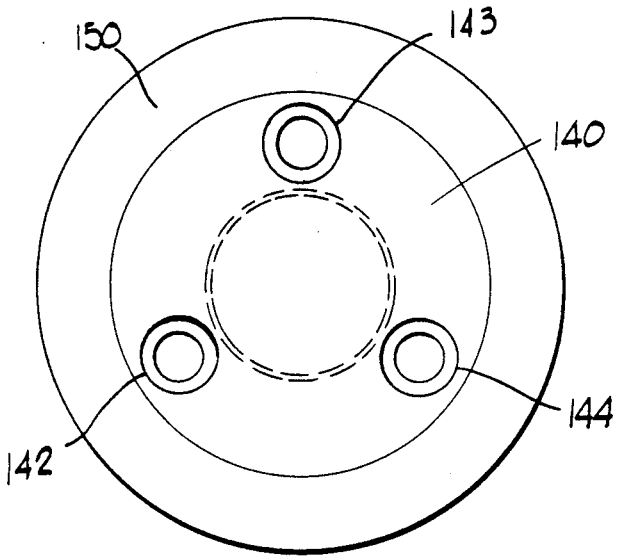
FIG. 7 is a plan view of an alternative embodiment of a support pad member with a ceramic insert.
Figure 8:
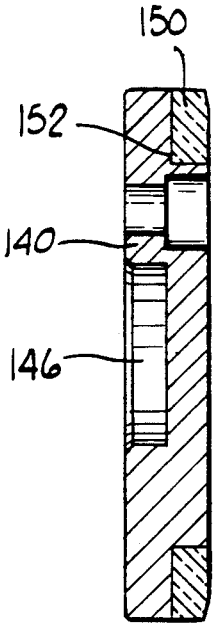
FIG. 8 is a cross-sectional view of the support pad member of FIG. 7.

FIGS. 6 & 7 show an alternative embodiment comprising a stainless steel base member 140 having three circumferentially spaced screw holes 142, 143, 144 and a central clearance cavity 146. An annular ceramic ring member 150 of polygonal cross-sectional configuration is fixedly mounted in a recess 152 on the periphery of the steel base member 140. The ceramic material is preferably a Whisker reinforced material fixed in the recess 152 by a suitable bonding agent and then ground and polished as previously described. The outer annular edge portion is preferably inclined and rounded as previously described.

It is contemplated that the inventive concepts may be otherwise variously employed in alternative embodiments of the invention. It is intended that the appended claims be construed to include alternative embodiments except insofar as limited by the prior art.

What is claimed is:

1. A support pad device for supporting a can body member on a chuck mechanism during a seaming operation, the can body member having a bottom wall with an annular support rib portion and the device comprising:

a base plate member made of metallic material;

fastening hole means in said base plate member for attaching the support pad device to the chuck mechanism;

an upwardly facing annular recess in said base plate member; and an annular insert member made of ceramic material and being fixedly mounted in said annular recess and providing a flat upper surface on which said annular support rib portion is supported during the seaming operation.

2. The invention as defined in claim 1 and wherein said annular insert member having a polygonal cross-sectional configuration and further comprising:

an outermost flat peripheral side surface;

a radially innermost flat peripheral side surface;

a flat bottom surface;

a flat upper surface; and an inclined edge surface extending between said outermost peripheral side surface and said flat upper surface.

3. The invention as defined in claim 2 and wherein:

said fastening hole means comprising a central fastening hole;

said radially innermost side surface of said annular insert member being located closely adjacent said central fastening hole.

4. The invention as defined in claim 2 and wherein:

said fastening hole means comprising a plurality of circumferential spaced fastening holes;

said radially innermost peripheral side surface of said annular insert member being located radially outwardly of and closely adjacent to said fastening holes.

5. The invention as defined in claim 1 and further comprising:

vent passage means extending from a central portion of the upper surface of said base plate member to a peripheral side surface for venting the space between the bottom wall of the can member and the base plate member during a seaming operation.

6. The invention as defined in claim 1 and wherein said ceramic material is a whisker reinforced alumina material.

7. The invention as defined in claim 1 and wherein said base plate member has a flat upper surface which is coplanar with said flat upper surface of said insert member.

* * * * *